US007775263B2

(12) United States Patent
Han

(10) Patent No.: US 7,775,263 B2
(45) Date of Patent: Aug. 17, 2010

(54) HEAT EXCHANGER

(75) Inventor: Seongseok Han, Daejeon-si (KR)

(73) Assignee: Halla Climate Control Corporation, Daejeon-Si (KR)

( * ) Notice: Subject to any disclaimer, the term of this patent is extended or adjusted under 35 U.S.C. 154(b) by 327 days.

(21) Appl. No.: 11/784,937

(22) Filed: Apr. 10, 2007

(65) Prior Publication Data

US 2007/0240850 A1 Oct. 18, 2007

(30) Foreign Application Priority Data

Apr. 14, 2006 (KR) ..... 10-2006-0033978

(51) Int. Cl.
*F28F 9/26* (2006.01)

(52) U.S. Cl. ..... 165/144; 165/176; 237/12.3 B

(58) Field of Classification Search ..... 165/144, 165/176; 237/12.3 B
See application file for complete search history.

(56) References Cited

U.S. PATENT DOCUMENTS 4,432,410 A * 2/1984 Cadars ..... 165/296
4,559,994 A * 12/1985 Waldmann et al. ..... 165/41
4,712,608 A * 12/1987 Arold et al. ..... 165/41
5,794,845 A * 8/1998 Ito et al. ..... 237/12.3 B
5,915,464 A 6/1999 Kalbacher et al.
5,968,312 A 10/1999 Sephton
6,073,858 A * 6/2000 Obara et al. ..... 237/12.3 B
6,082,448 A 7/2000 Haussmann
6,109,534 A 8/2000 Ito
6,427,770 B2 * 8/2002 Beck et al. ..... 165/203

FOREIGN PATENT DOCUMENTS

EP 0 991 464 12/1998
EP 1 410 929 A2 4/2004
EP 1 515 110 A2 3/2005
GB 391556 5/1933
KR 10-0170234 B1 10/1988

OTHER PUBLICATIONS

Abstract of JP 55022504.

* cited by examiner

*Primary Examiner*—Teresa J Walberg
(74) *Attorney, Agent, or Firm*—Fulbright & Jaworski L.L.

(57) ABSTRACT

The present invention relates to a heat exchanger, which can independently controls the volume of heat exchange medium flowing through tubes of a left heat exchange part and a right heat exchange part to independently control the temperature of a driver's seat and a passenger's seat, thereby realizing a compact structure since a temp door for controlling temperature is omitted from an air-conditioning system for the vehicle, which can reduce an operating force and increase durability since heat exchange medium controlling means are in a rotational structure, and which can minimize a temperature difference between the right and left sides thereof since the heat exchange medium is distributed to the tubes uniformly.

13 Claims, 10 Drawing Sheets

Prior Art

Prior Art

Prior Art

HEAT EXCHANGER

This application claims priority from Korean Patent Application No. 10-2006-0033978 filed Apr. 14, 2006, incorporated herein by reference in its entirety.

BACKGROUND OF THE INVENTION

1. Field of the Invention

The present invention relates to a heat exchanger, and more particularly, to a heat exchanger, which can independently controls the volume of heat exchange medium flowing through tubes of a left heat exchange part and a right heat exchange part to independently control the temperature of a driver's seat and a passenger's seat, thereby realizing a compact structure since a temp door for controlling temperature is omitted from an air-conditioning system for the vehicle, which can reduce an operating force and increase durability since heat exchange medium controlling means are in a rotational structure, and which can minimize a temperature difference between the right and left sides thereof since the heat exchange medium is distributed to the tubes uniformly.

2. Background Art

In general, an air conditioner includes a cooling system and a heating system. The cooling system cools the inside of a vehicle by heat exchange performed by an evaporator during a process that heat exchange medium discharged by an operation of a compressor circulates into the compressor after passing through a condenser, a receiver drier, an expansion valve and the evaporator. The heating system introduces the heat exchange medium (engine cooling water) to a heater core and heat-exchanges it to heat the inside of the vehicle.

The condenser, the evaporator and the heater core for heat-exchanging heat exchange medium are called a heat exchanger. The heat exchanger is provided with the heat exchange medium, and then, circulates it after heat-exchanging it to a proper temperature.

As shown FIG. 1, the conventional heat exchanger includes: a plurality of tubes 5 whose both ends are fixed to upper and lower headers 1 and 3, the tubes 5 being spaced from one another at regular intervals; upper and lower tanks 7 and 9 respectively connected with the upper and lower headers 1 and 3 and forming passageways fluidically communicating with ends of the tubes 5; and radiation fins 11 mounted between the tubes 5 to widen a radiation surface area.

The conventional heat exchanger having the above configuration, in a state where the heat exchanger is installed in an air conditioner, particularly, for the vehicle, the heat exchange medium supplied to the passageway formed by the upper tank 7 and the upper header 1 performs heat exchange with the air around the heat exchanger while passing through the tubes 5 of a side partitioned by baffles, performs heat exchange again while passing through the tubes 5 of the other side after taking a U-tern in the passageway formed by the lower tank 9 and the lower header 3, and then, discharged through the passageway formed by the upper tank 7 and the upper header 1.

The conventional heat exchanger performing heat exchange as described above needs separate controlling means to control a heat exchange capacity according to a heating load or a cooling load since heat exchange medium (cooling water for the vehicle) is supplied without regard to the heating load or the cooling load. For instance, to control the heat exchange capacity of the heat exchanger, the heat exchanger used as the heater core for the vehicle controls the volume of air passing through the heat exchanger by adjusting rotational frequency of an air blast or installing a temp door on the front of the heat exchanger. However, to control the heat exchange capacity by adjusting the volume of air needs a separate device, it cannot provide a secure control.

To solve the above problem, Korean Patent No. 170,234, which has been patented to the same inventor as the present invention, discloses a heat exchanger. In Korean Patent No. 170,234, as shown in FIGS. 2 and 3, the heat exchanger includes: a plurality of tubes 5 whose ends are fixed to upper and lower headers 1 and 3, the tubes 5 being aligned at regular intervals; a partitioning and supplying means 13 connected to the upper header 1 to supply heat exchange medium to the specific tubes 5; and a lower tank 9 connected to the upper header 3 and fluidically communicated with ends of the tubes 5.

The partitioning and supplying means 13 includes: a plurality of connection passageways 15 fluidically communicating with the upper end portions of the tubes 5 combined to the upper header 1; a main body 17 in which inlet sides of the connection passageways 15 are formed within a range of a predetermined angle, the main body 17 having a cylindrical heat exchange medium dividing portion; at least one heat exchange medium supply pipe 21 formed to be fluidically communicated with the heat exchange medium dividing portion 19 of the main body 17; a rotating member 23 rotatably mounted on the heat exchange medium dividing portion 19 and having a rotary shaft 25 on which a blocking vane 27 for selectively blocking entrances of the connection passageways 15 fluidically communicated with the heat exchange medium dividing portion 19 is mounted; and a cover member 29 for supporting the rotary shaft 25 and intercepting the heat exchange medium dividing portion 19.

In the above state, to perform heat exchange with the heat exchange medium using the heat exchanger, first, the heat exchange medium is supplied through the heat exchange medium supply pipe 21 and the rotating member 23 rotatably mounted on the heat exchange medium dividing portion 19 is rotated according to a load applied to the heat exchanger, and then, the blocking vane 27 selectively opens or closes the entrances of the connection passages 15 according to the rotation of the rotating member 23 to thereby supply the heat exchange medium to some or all of the tubes 5.

In case where the entrances of the connection passageways 15 are formed at both sides, the blocking vanes 27 mounted at both sides of the rotating member 23 simultaneously open ends of the tubes 5 to thereby supply the heat exchange medium to some of the tubes 5, and the heat exchange capacity of the heat exchanger is freely controlled since a supplied volume of the heat exchange medium can be adjusted according to the rotation of the rotating member 23.

As described above, the heat exchanger can easily cope with heating or cooling load since it can freely control the heat exchange capacity by making the heat exchange medium selectively flow to the tubes 5 of the heat exchanger.

The heat exchanger can selectively adjust the volume of the heat exchange medium, but has several problems in that a mixing performance of the heat exchange medium is deteriorated and there is a severe temperature difference in right and left temperature between the right and left sides of the heat exchanger since the heat exchange medium guided by the blocking vane 27 of the rotating member 23 is concentrated on tube arrays of one side of the heat exchanger.

In addition, the conventional heat exchanger has another problem in that temperature of a driver's seat and temperature of a passenger's seat cannot be controlled separately since temperature control is applied to the whole of the heat exchanger.

SUMMARY OF THE INVENTION

Accordingly, the present invention has been made to solve the above-mentioned problems occurring in the prior arts, and it is an object of the present invention to provide a heat exchanger, which can independently controls the volume of heat exchange medium flowing through tubes of a left heat exchange part and a right heat exchange part to independently control the temperature of a driver's seat and a passenger's seat, thereby realizing a compact structure since a temp door for controlling temperature is omitted from an air-conditioning system for the vehicle, which can reduce an operating force and increase durability since heat exchange medium controlling means are in a rotational structure, and which can minimize a temperature difference between the right and left sides thereof since the heat exchange medium is distributed to the tubes uniformly.

To accomplish the above object, according to the present invention, there is provided a heat exchanger including: a plurality of tubes whose both ends are combined to an upper header and a lower header, the tubes being divided into a left heat exchange part and a right heat exchange part; an upper tank having a first tank combined to the upper header and a second tank embedded in the first tank, the first tank having an inlet pipe and an outlet pipe, the second tank having a pair of guiding parts dividing the inner space of the first tank into a supply chamber fluidically communicated with the tubes and a discharge chamber fluidically communicated with a return pipe in relation with a partitioning wall to thereby supply heat exchange medium received through an inlet pipe to the tubes of the left heat exchange part and the right heat exchange part and discharge the heat exchange medium, which is returned through the return pipe mounted in parallel with the tubes after passing through the tubes, to an outlet pipe; heat exchange medium controlling means rotatably mounted on the guiding parts so as to be independently operated by an external driving force, and adapted to control the volume of the heat exchange medium supplied to the tubes of the left heat exchange part and the right heat exchange part through the supply chamber from the inlet pipe; and a lower tank combined to the lower header for returning the heat exchange medium discharged from the tubes of the left heat exchange part and the right heat exchange part to the return pipe.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Reference will be now made in detail to the preferred embodiment of the present invention with reference to the attached drawings.

Figure 1:
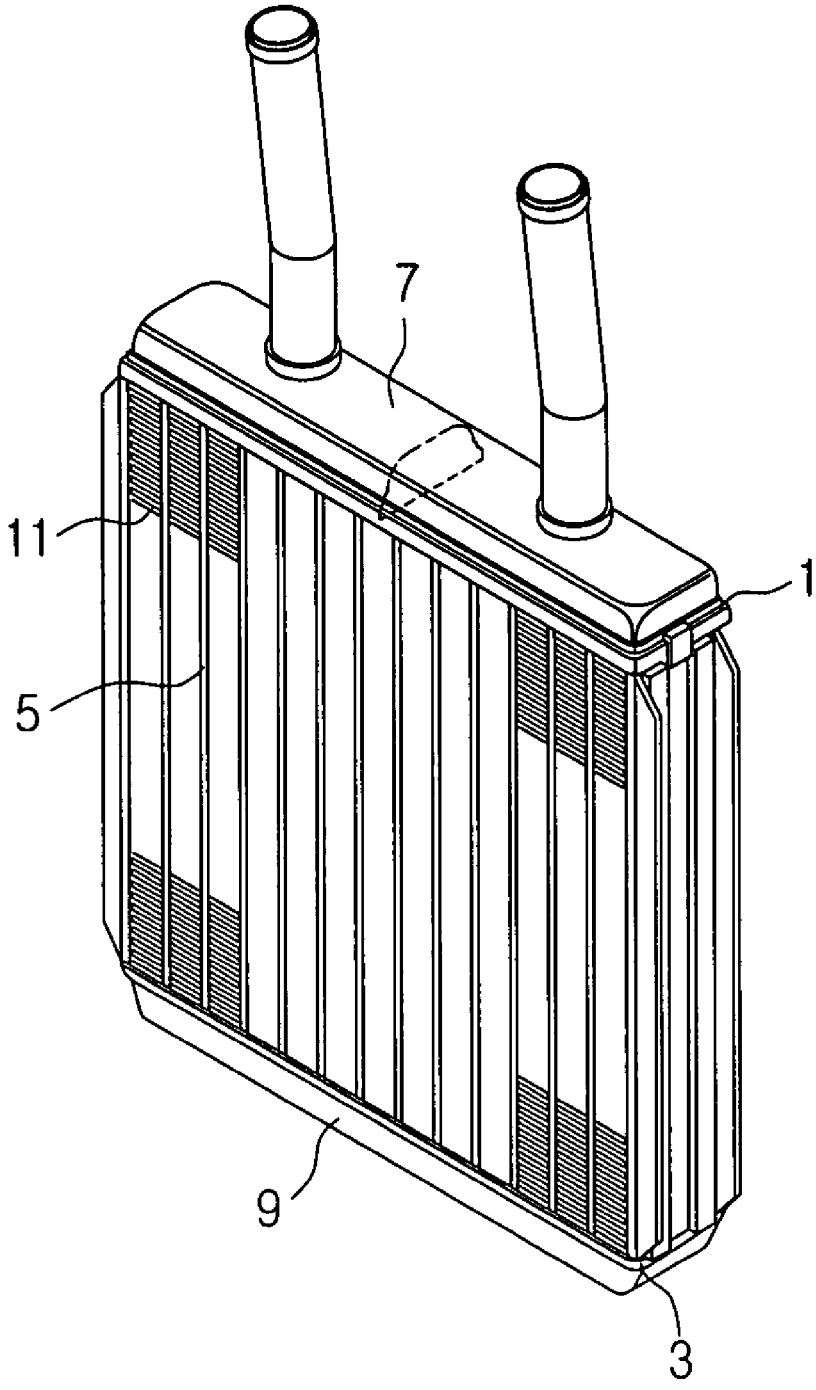
FIG. 1 is a perspective view of a heat exchanger according to a prior art.
Figure 2:
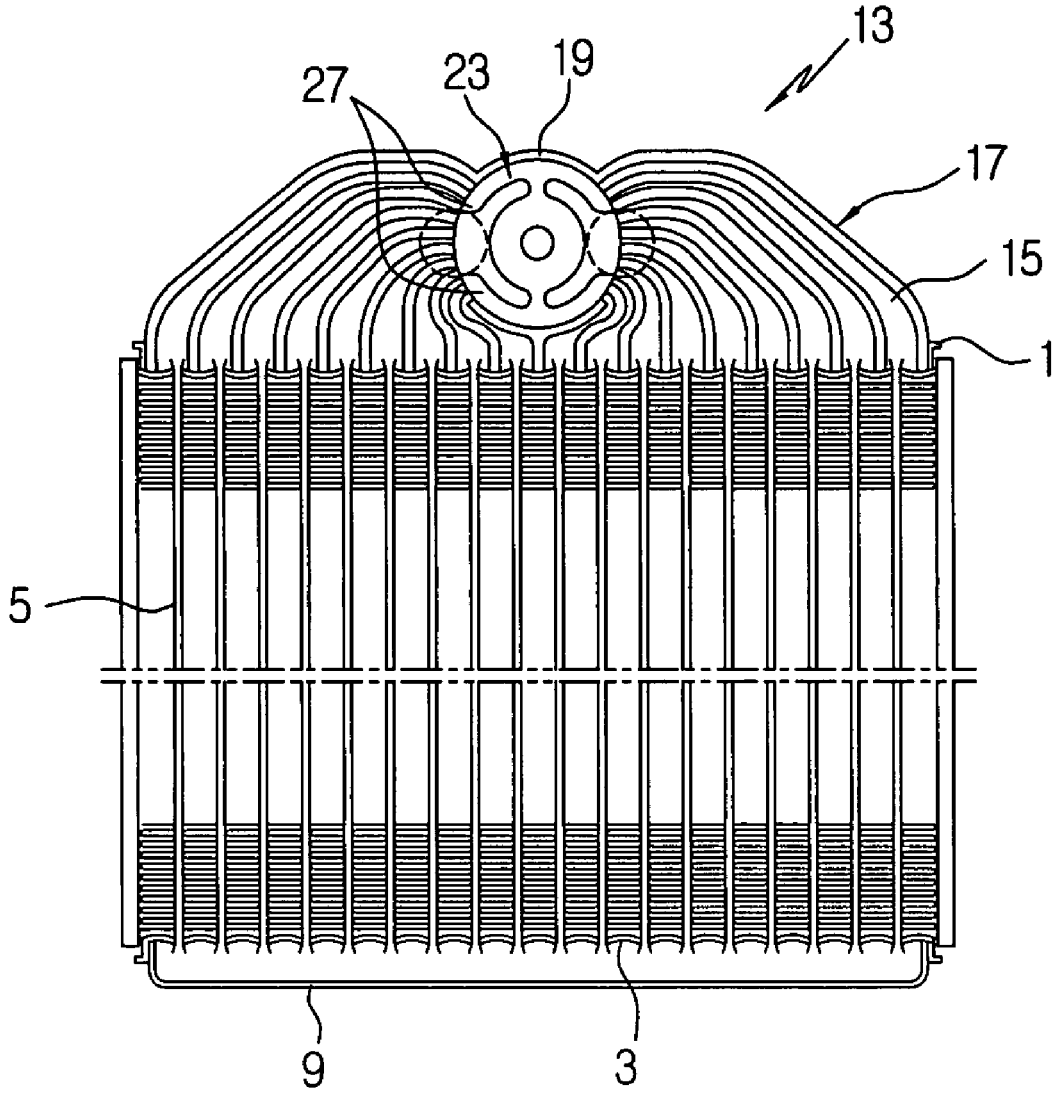
FIG. 2 is a front view of a heat exchanger according to another prior art.
Figure 3:
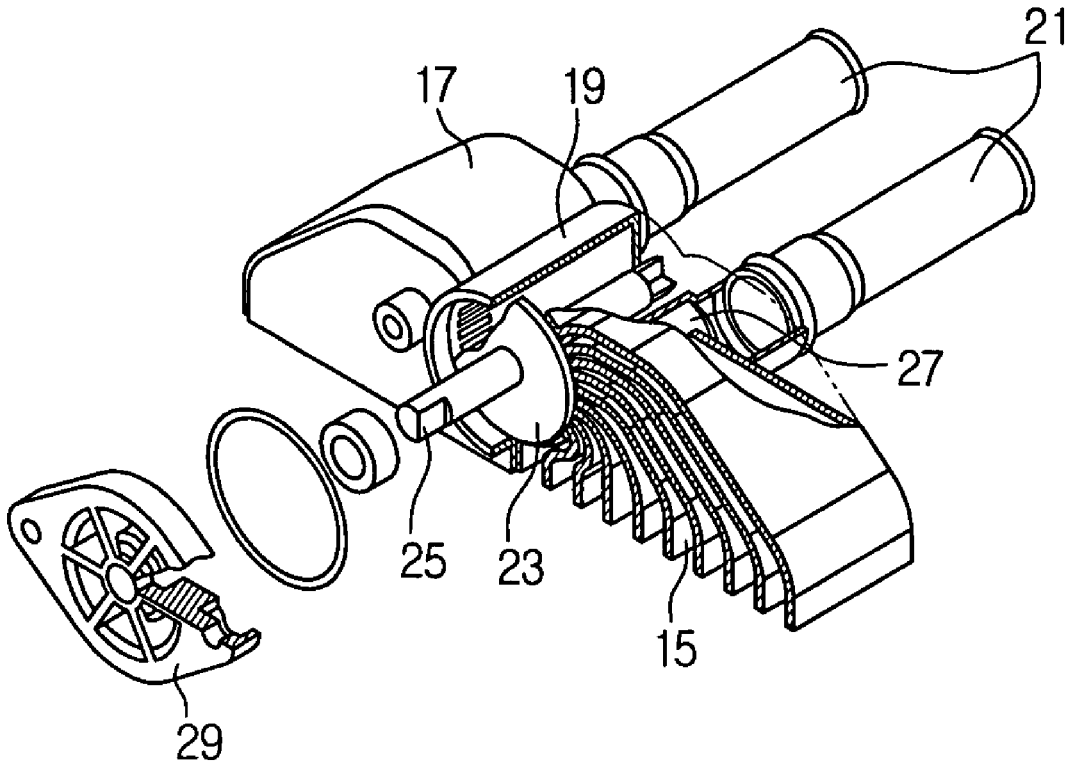
FIG. 3 is a partially enlarged perspective view of FIG. 2.
Figure 4:
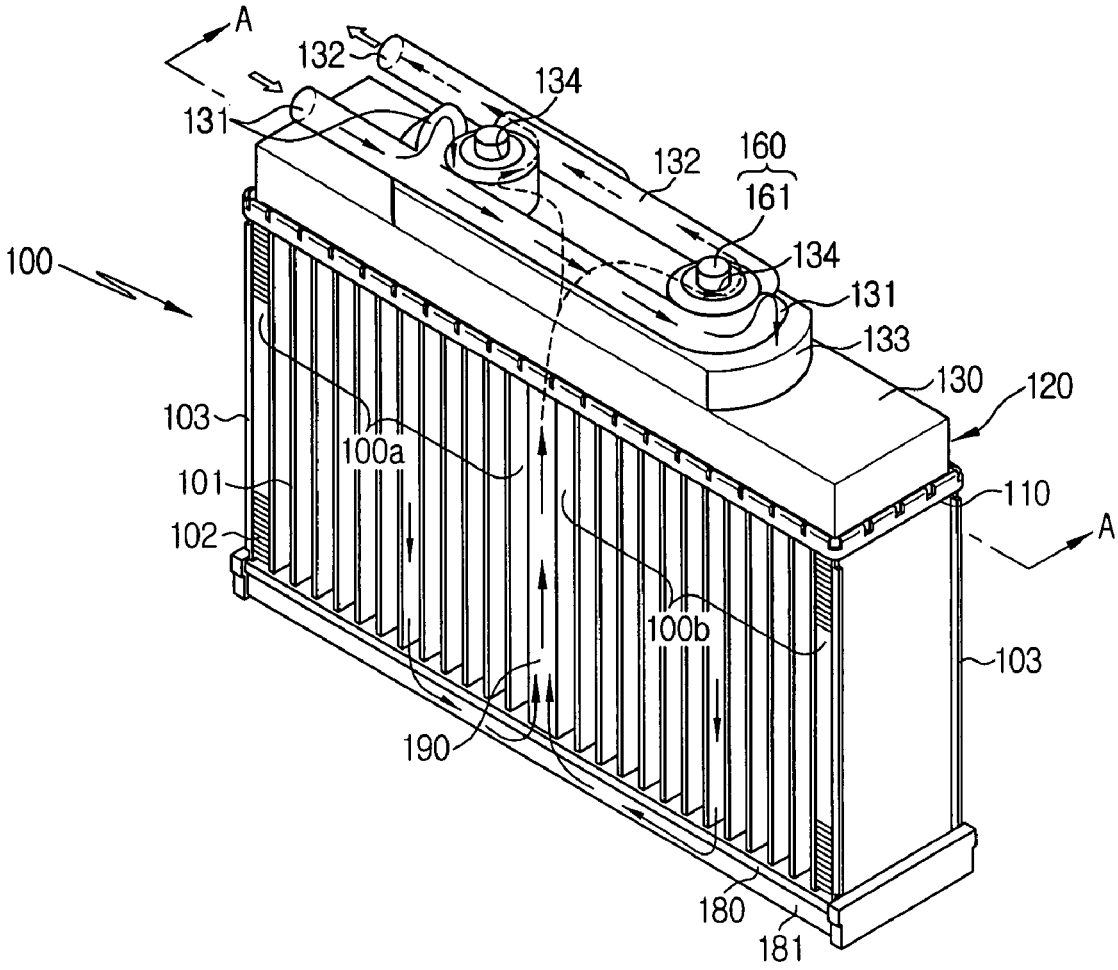
FIG. 4 is a perspective view of a heat exchanger according to the present invention.
Figure 5:
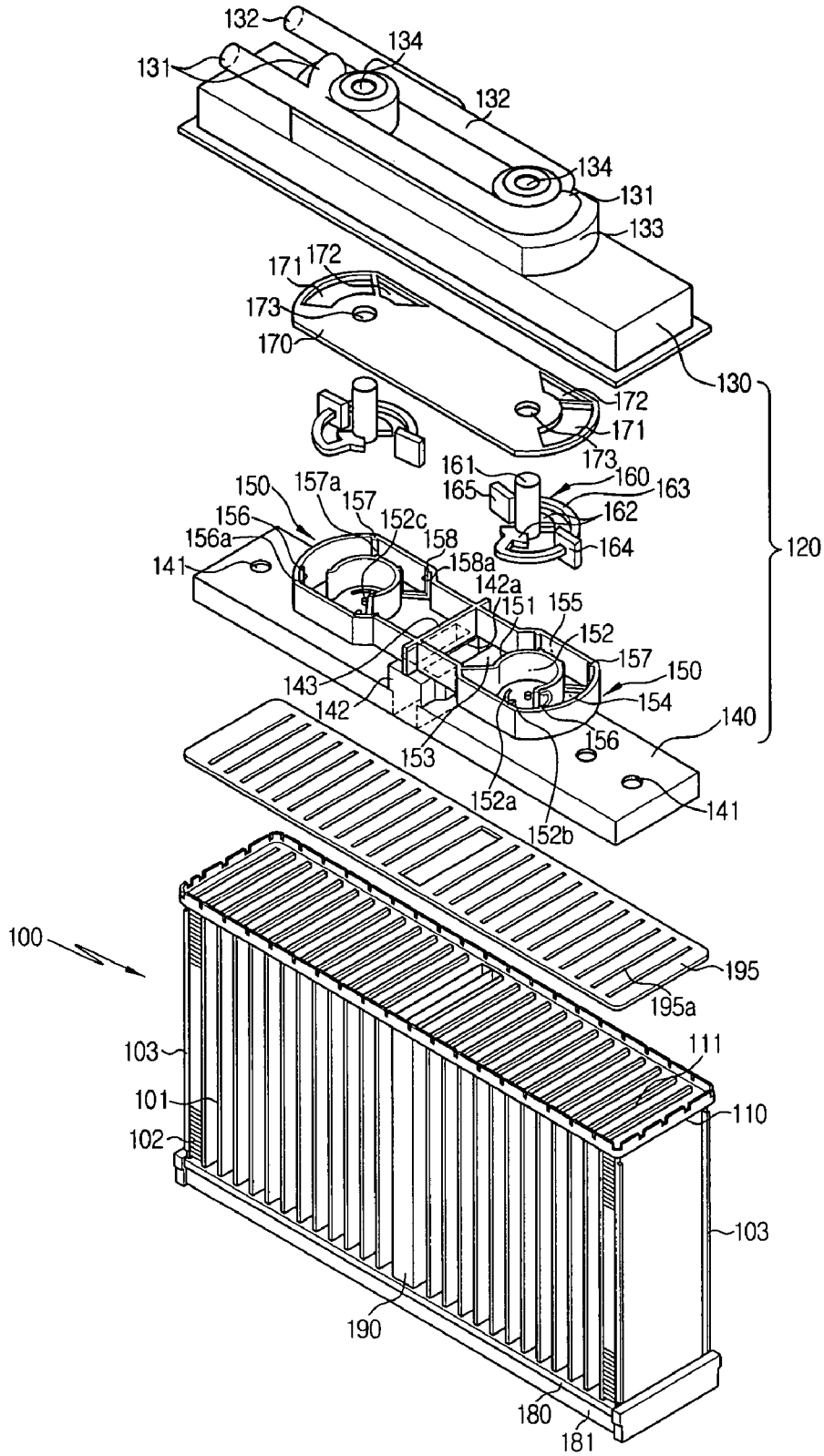
FIG. 5 is an exploded perspective view of the heat exchanger according to the present invention.
Figure 6:
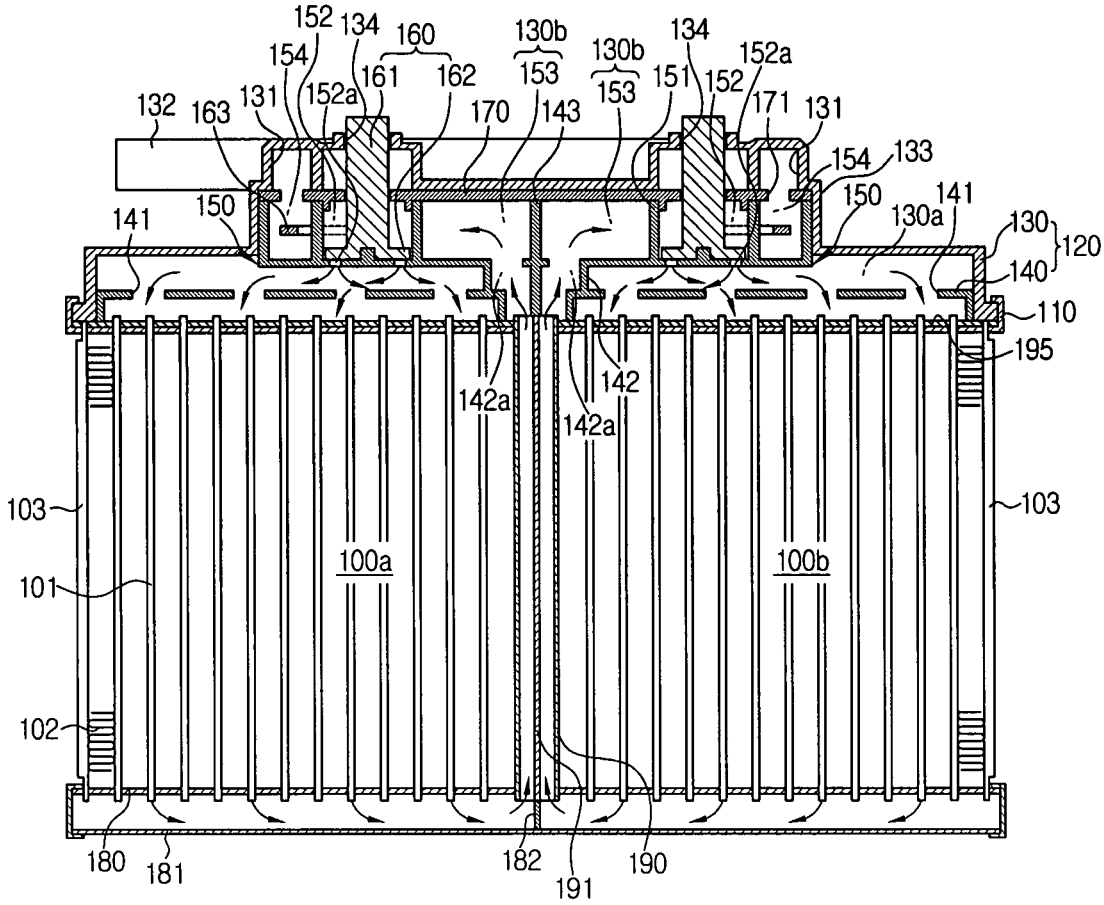
FIG. 6 is a sectional view taken along the line of A-A of FIG. 4.
Figure 7:
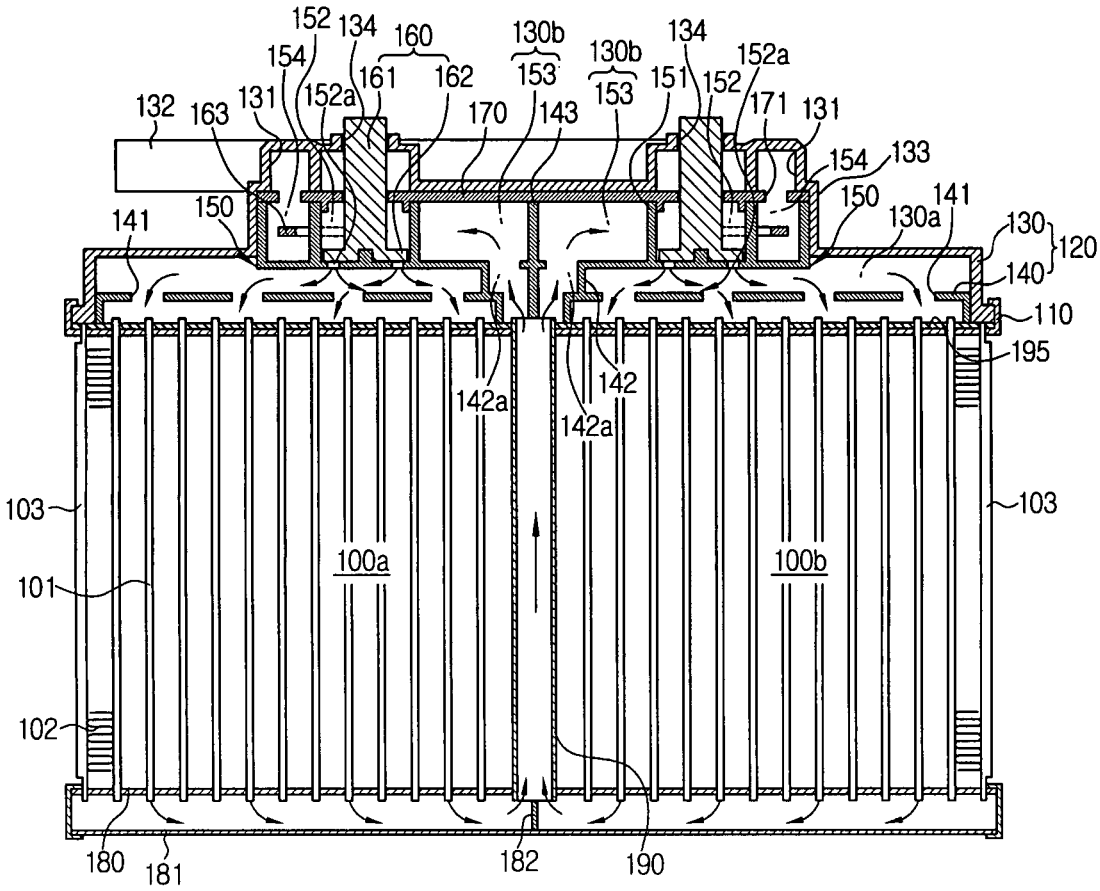
FIG. 7 is a sectional view showing a state where a partitioning wall of a return pipe of FIG. 6 is omitted.
Figure 8:
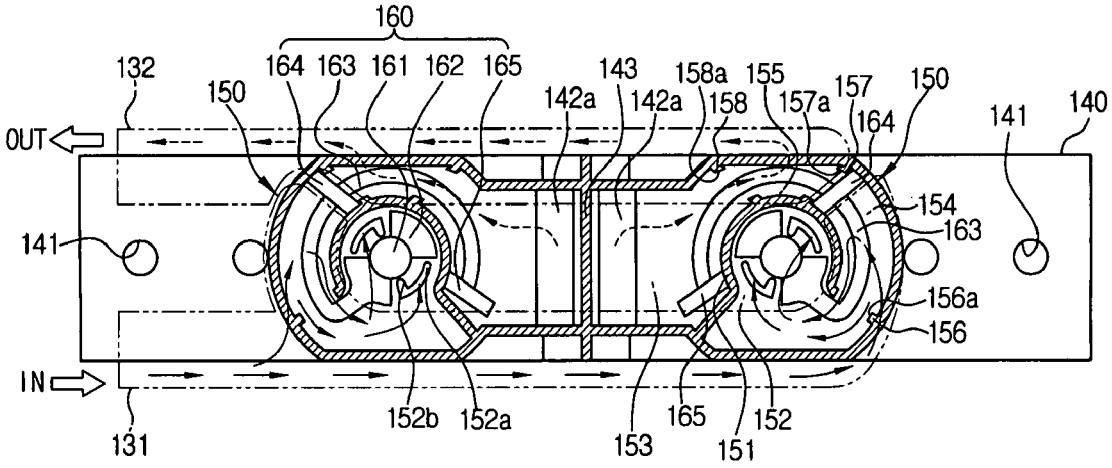
FIGS. 8 to 10 are plan views illustrating a flow of heat exchange medium according to an operational state of heat exchange medium controlling means in the heat exchanger according to the present invention.
Figure 9:
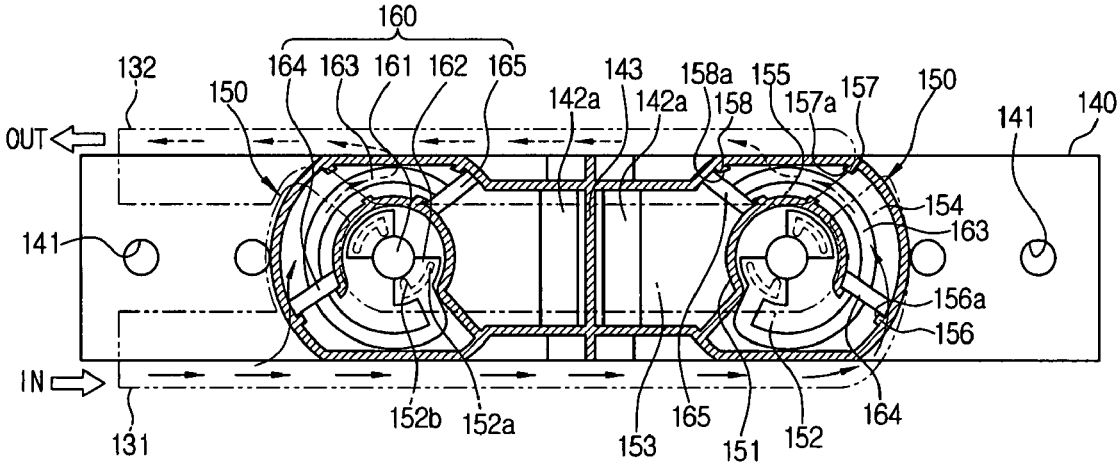
Figure 10:
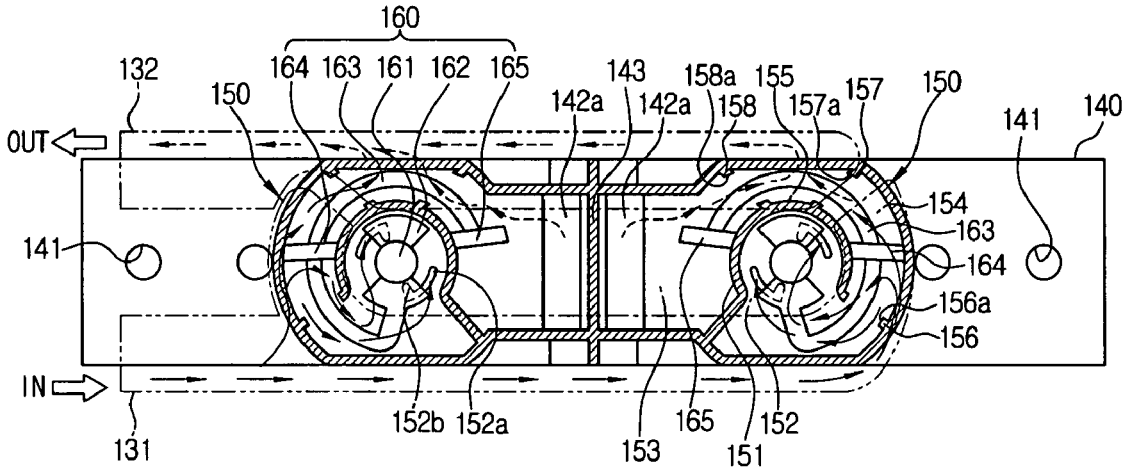

FIG. 4 is a perspective view of a heat exchanger according to the present invention, FIG. 5 is an exploded perspective view of the heat exchanger according to the present invention, FIG. 6 is a sectional view taken along the line of A-A of FIG. 4, FIG. 7 is a sectional view showing a state where a partitioning wall of a return pipe of FIG. 6 is omitted, and FIGS. 8 to 10 are plan views illustrating a flow of heat exchange medium according to an operational state of a heat exchange medium controlling means in the heat exchanger according to the present invention.

As shown in the drawings, the heat exchanger 100 according to the present invention includes a plurality of tubes 101 for allowing a flow of heat exchange medium, the tubes being arranged at regular intervals and having ends combined to an upper header 110 and a lower header 180.

The tubes 101 are divided into a left heat exchange part 100*a* and a right heat exchange part 100*b* in relation with a return pipe 190 which will be described later.

In addition, radiation fins 102 are mounted between the tubes 101 to promote heat exchange performance by widening a heat transfer area, and side supports 103 are mounted on both sides of the heat exchanger 100 and ends of the side supports 103 are combined to the upper header 110 and the lower header 180 to protect the tubes 101 and the radiation fins 102.

Furthermore, an upper tank 120 is combined to the upper header 110. The upper tank 120 includes: a first tank 130 having an inlet pipe 131 and an outlet pipe 132 formed on the upper end portion thereof and an opened lower end portion combined with the upper header 110; and a second tank 140 embedded in the first tank 130 and having a pair of guiding parts 150 dividing the inner space of the first tank 130 into a supply chamber 130*a* fluidically communicated with the tubes 101 and a discharge chamber 130*b* fluidically communicated with the return pipe 190 in relation with a partitioning wall 143 to thereby supply the heat exchange medium received through the inlet pipe 131 to the tubes 101 of the left heat exchange part 100*a* and the right heat exchange part 100*b* and discharge the heat exchange medium, which is returned through the return pipe 190 mounted in parallel with the tubes 101 after passing through the tubes 101, to the outlet pipe 132.

Each guiding part 150 includes: a supply passageway 152 and a discharge passageway 153 partitioned by a bulkhead 151 formed therein, the supply passageway 152 having an introduction hole 152*a* formed on the bottom thereof and fluidically communicating with the supply chamber 130*a*, the discharge passageway 153 fluidically communicating with the return pipe 190; and an inlet passageway 154 and an outlet passageway 155 formed in a circumferential direction of one side of the supply passageway 152, the inlet passageway 154 fluidically communicating with the inlet pipe 131, the outlet passageway 155 fluidically communicating with the outlet pipe 132. Additionally, a plurality of partitioning walls 156, 157 and 158 are formed among the supply passageway 152, the discharge passageway 153, the inlet passageway 154 and the outlet passageway 155 for partitioning the passageways 152, 153, 154 and 155 and respectively have opening and closing holes 156*a*, 157*a* and 158*a* opened and closed by heat exchange medium controlling means 160 which will be described later.

Here, the bulkhead 151 is in the form of a circle, and has an opened side fluidically communicated with the inlet passageway 154 and the supply passageway 152. Therefore, the heat exchange medium introduced into the inlet passageway 154 can be moved to the supply passageway 152.

Moreover, the supply passageway 152 is formed at the center of each guiding part 150, and the inlet passageway 154, the outlet passageway 155 and the discharge passageway 153 are respectively formed in the circumferential direction of the supply passageway 152.

Here, the guiding parts 150 respectively extend in a horizontal direction from the top of a support portion 142 of a predetermined height formed on the upper end of the second tank 140 in such a way as to be spaced from the top of the second tank 140 at a predetermined interval. Moreover, the guiding parts 150 are symmetric with each other in relation with the partitioning wall 143 formed at the center of the support portion 142.

In addition, the support portion 142 fluidically communicates each discharge passageway 153 of each guiding part 150, which are formed at both sides of the partitioning wall 143, with the return pipe 190 through internal passageways 142*a* partitioned by the partitioning wall 143.

The guiding parts 150 is preferably located at the center of the heat exchanger 100, but may be changed in its location according to a temperature adjustability to thereby adjust a relative ratio between the left heat exchange part 100*a* and the right heat exchange part 100*b*. Of course, when the location of the guiding parts 150 is changed, the location of the return pipe 190 is also changed.

In the drawings, the guiding parts 150 are located at the center of the heat exchanger 100. However, the guiding parts 150 may be mounted at both end portions of the heat exchanger 100 in such a way as to be separated from each other, and the return pipes 190 may be also mounted at both end portions of the heat exchanger 100. Also in this instance, it is natural that the discharge passageways 153 of the guiding parts 150 and the return pipes 190 are fluidically communicated with each other.

A plurality of the introduction holes 152*a* formed on the bottom of the supply passageway 152 are formed in an arc shape (two in the drawings) at portions spaced at a predetermined distance outwardly from the center of the supply passageway 152.

In addition, the introduction holes 152*a* are formed in such a way as to vary their cross sectional areas so that the heat exchange medium is introduced little by little during an early opening of the introduction holes 152*a* but introduced maximally during the maximum opening.

That is, if the cross sectional areas of the introduction holes 152*a* are all the same, since excessive heat exchange medium may be introduced during the early opening of the introduction holes 152*a* by the heat exchange medium controlling means 160, the introduction hole 152*a* located at the early opening position has a smaller cross sectional area and the introduction hole 152*a* located at the maximum opening position has a larger cross sectional area to thereby vary an amount of the introduced heat exchange medium according to steps.

Here, the introduction holes 152*a* are preferably formed in the arc shape, and an expanded hole 152*b* is formed at the maximum opening position of the introduction hole 152*a* to allow the maximum introduction of the heat exchange medium. Not shown in the drawings, but the introduction hole 152*a* may be formed in one of various shapes, for instance, one introduction hole 152*a* is divided into several portions.

The second tank 140 has a plurality of supply holes 141 spaced at a predetermined intervals to uniformly supply the heat exchange medium contained in the supply chambers 130*a* to the tubes 101 of the left heat exchange part 100*a* and the right heat exchange part 100*b* when the heat exchange medium introduced through the inlet pipe 131 is supplied to the supply chambers 130*a* located at both sides of the partitioning wall 143 through the introduction holes 152*a* of the supply passageways 152.

So, since the heat exchange medium supplied into the supply chambers 130*a* are uniformly supplied to the tubes 101 through the plural supply holes 141, the heat exchange medium is not concentrated on one side, and so, there is no temperature difference between the right and left heat exchange parts 100*a* and 100*b* of the heat exchanger 100.

Here, the supply holes 141 may be formed in various intervals, sizes and shapes to distribute the heat exchange medium uniformly.

Meanwhile, a housing part 133 in which the guiding parts 150 are contained is protrudingly formed on the upper end of the first tank 130, and the housing part 133 fluidically communicates the inlet pipe 131 and the outlet pipe 132 formed on the upper portion thereof with the inlet passageways 154 and the outlet passageways 155 of the guide parts 150 and rotatably supports the heat exchange medium controlling means 160.

That is, since the one inlet pipe 131 formed on the housing part 133 of the first tank 130 is fluidically communicated with the inlet passageways 154 of the guide parts 150 and the one outlet pipe 132 is fluidically communicated with the outlet passageways 155 of the guide parts 150, the heat exchanger 100 according to the present invention can adjust temperature at the right and left parts using the one inlet pipe 131 and the one outlet pipe 132.

Furthermore, since the inlet pipe 131 and the outlet pipe 132 are formed in the same direction, when external pipes are connected to the inlet pipe 131 and the outlet pipe 132 for movement of the heat exchange medium, they can be detachably mounted with ease. Of course, the inlet pipe 131 and the outlet pipe 132 may be formed in the opposite direction to each other.

Meanwhile, the heat exchange medium passing through the tubes 101 of the left heat exchange part 100*a* and the right heat exchange part 100*b* returns at the lower tank 181, passes through the discharge passageways 153 of the guiding parts 150, which are the discharge chambers 130*b* of the upper tank 120, through the return pipe 190, and then discharged to the outlet pipe 132 after flowing through the outlet passageways 155. Here, the return pipe 190 is arranged between the left heat exchange part 100*a* and the right heat exchange part 100*b* in parallel with the tubes 101. A separation wall 191 is formed inside the return pipe 190 so that the heat exchange medium discharged from the tubes 101 of the left heat exchange part 100*a* and the heat exchange medium discharged from the tubes 101 of the right heat exchange part 100*b* flow to the upper tank 120 in a separated state.

That is, the heat exchange medium passing through the tubes 101 of the left heat exchange part 100*a* and the heat exchange medium passing through the tubes 101 of the right heat exchange part 100*b* pass through the return pipe 190 in a separated state by the separation wall 191, and then, flow into the discharge passageways 153 formed at both sides of the partitioning wall 143.

It is preferable that the return pipe 190 is a collapsible tube having the separation wall 191 formed at the center of the inside thereof. In addition, as described above, the return pipe 190 is preferably mounted between the left heat exchange part 100*a* and the right heat exchange part 100*b* at the center of the heat exchanger 100, but may be varied in its mounted position according to the temperature adjustability. Moreover, a plurality of the return pipes 190 may be mounted in parallel with the tubes 101 according to a temperature distribution and a flow amount. Of course, it is natural that the return pipe 190 and the discharge passageways 153 of the guiding parts 150 must be always fluidically communicated with each other even though the mounted position or the number of the return pipe 190 are changed.

Meanwhile, as shown in FIG. 7, the separation wall 191 formed at the center of the inside of the return pipe 190 may be omitted. In this instance, when the heat exchange medium passing through the left heat exchange part 100*a* and the heat exchange medium passing through the right heat exchange part 100*b* meet with each other at the one return pipe 190, the return pipe 190 absorbs a pressure difference generated due to a volume difference between the heat exchange medium of the left heat exchange part 100*a* and the heat exchange medium of the right heat exchange part 100*b* and discharges cooling water to the left discharge passageway 153 and the right discharge passageway 153 to thereby prevent that excessive pressure is applied only to one of the heat exchange parts.

Moreover, a sealing member 170 is sealably mounted between opened upper ends of the guiding parts 150 and the inner wall of the housing part 133 of the first tank 130. The sealing member 170 includes: inlet communicating holes 171 for fluidically communicating the inlet pipe 131 with the inlet passageways 154 of the guiding part 150; outlet communicating holes 172 for fluidically communicating the outlet pipe 132 with the outlet passageways 155 of the guiding parts 150; and through holes 173 to which rotary shafts 161 of the heat exchange medium controlling means 160 are inserted.

The heat exchange medium controlling means 160 are rotatably mounted on the guiding parts 150. The heat exchange medium controlling means 160 are respectively operated by a driving force and control the volume of the heat exchange medium supplied to the left heat exchange part 100*a* and the volume of the heat exchange medium supplied to the right heat exchange part 100*b* through the supply chambers 130*a* from the inlet pipe 131.

Each heat exchange medium controlling means 160 includes: a rotary shaft 161 rotatably mounted inside the supply passageway 152 of the guiding part 150; a supply valve 162 protrudingly mounted on the lower end portion of the rotary shaft 161 in a radial direction; a connection member 163 formed on the rotary shaft 161 or the supply valve 162 in such a way as to be rotated when the rotary shaft 161 is rotated, an end portion of the connection member 163 extending to the discharge passageway 153 passing through the inlet passageway 154 and the outlet passageway 155; and a discharge valve 165 combined to the end portion of the connection member 163 for opening and closing the opening and closing hole 158*a* of the partitioning wall 158 formed between the discharge passageway 153 and the outlet passageway 155.

The lower end portion of the rotary shaft 161 is rotatably combined to a protrusion 152*c* formed on the bottom of the supply passageway 152, and the upper end portion rotatably passes through a support hole 134 formed on the upper end of the housing part 133 of the first tank 130. In this instance, the upper end portion of the rotary shaft 161 protruding to the outside through the support hole 134 is connected with an actuator (not shown) to receive the external driving force.

The supply valve 162 is in a fan shape to open and close the arc-shaped introduction hole 152*a*, and it is preferable that the number of the supply valves 162 (two in the drawings) is proportionate to the number of the introduction holes 152*a*. Therefore, an opened and closed amount of the introduction holes 152*a* can be controlled according to a rotated angle of the rotary shaft 161.

Meanwhile, it is preferable that the lower surface of the supply valve 162 is coated with a sealing material to improve sealability between the supply valve 162 and the introduction hole 152*a*.

Furthermore, the connection member 163 is extended from one side of the supply valve 162 and has a predetermined curvature in relation with the rotary shaft 161.

In addition, a bypass valve 164 is combined to the connection member 163 and arranged inside the inlet passageway 154 to open and close the opening and closing holes 156*a* and 157*a* formed on the partitioning walls 156 and 157 formed on both sides of the inlet passageway 154, so that the heat exchange medium introduced into the inlet passageway 154 through the inlet pipe 131 is supplied to the supply passageway 152 or bypassed to the outlet passageway 155.

That is, the bypass valve 164 opens and closes the opening and closing hole 156*a* of the partitioning wall 156 formed between the inlet passageway 154 and the supply passageway 152 and the opening and closing hole 157*a* of the partitioning wall 157 formed between the inlet passageway 154 and the outlet passageway 155. As described above, the heat exchanger 100 can control the volume of the heat exchange medium supplied to the tubes 101 and the volume of the heat exchange medium straight bypassed to the outlet pipe 132 using the one bypass valve 164 mounted inside the inlet passageway 154.

Moreover, during the bypass, since the bypass valve 164 closes the opening and closing hole 156*a* of the partitioning wall 156 formed between the inlet passageway 154 and the supply passageway 152 and the supply valve 162 also closes the introduction hole 152*a* at the same time, the heat exchanger 100 can minimize the volume of the heat exchange medium leaked toward the tubes 101.

Meanwhile, the bypass valve 164 and the discharge valve 165 perform an opening and closing motion in a perpendicular direction to the partitioning walls 156, 157 and 158 to minimize friction force.

The lower tank 181 is combined to the lower header 180 to return the heat exchange medium discharged from the tubes 101 of the left heat exchange part 100*a* and the right heat exchange part 100*b* to the return pipe 190.

A baffle 182 is combined at a position corresponding to the separation wall 191 of the return pipe 190 inside the lower tank 181, so that the heat exchange medium discharged from the tubes 101 of the left heat exchange part 100*a* and the heat exchange medium discharged from the right heat exchange part 100*b* can be returned to the return pipe 190 in a separated state.

Meanwhile, it is preferable that a rubber member 195 is inserted between the upper header 110 and the upper tank 120 to provide sealability. Moreover, tube holes 111 and 195*a* are formed on the upper header 110, the lower header 180 and the rubber member 195 to pass the tubes 101 therethrough.

As described above, when the heat exchange medium is introduced to the inlet passageways 154 of the guiding parts 150 through the inlet pipe 131 of the upper tank 120, the heat exchange medium performs heat exchange with the outside air while directly bypassing to the outlet pipe 132 through the outlet passageways 155 of the guiding parts 150 or flowing along the tubes 101 of the left heat exchange part 100*a* and the right heat exchange part 100*b* through the supply passageways 152 of the guiding parts 150 according to the control of the heat exchange medium controlling means 160, and then, discharged to the outlet pipe 132 after returning through the return pipe 190.

Here, when the heat exchange medium controlling means 160 is rotated at a predetermined angle after the rotary shaft 161 receives the external driving force from the actuator, the connection member 163 is also rotated. In this instance, the supply valve 162 opens and closes the introduction hole 152*a* and the bypass valve 164 and the discharge valve 165 open and close the opening and closing holes 156*a*, 157*a* and 158*a* of the partitioning walls 156, 157 and 158 to thereby control a flow of the heat exchange medium and the volume of the heat exchange medium supplied to the tubes 101. Of course, the heat exchange medium controlling means 160 respectively mounted on the guiding parts 150 can be separately operated to independently control the temperature of a driver's seat and a passenger's seat.

Hereinafter, a circulation process of the heat exchange medium will be described in more detail.

First, when the supply valve 162 maximally opens the introduction hole 152*a* (maximum heating mode), the bypass valve 164 closes the opening and closing hole 157*a* of the partitioning wall 157 located between the inlet passageway 154 and the outlet passageway 155 and maximally opens the opening and closing hole 156*a* of the partitioning wall 156 located between the inlet passageway 154 and the supply passageway 152. In this instance, the discharge valve 165 maximally opens the opening and closing hole 158*a* of the partitioning wall 158 located between the discharge passageway 153 and the outlet passageway 155.

Therefore, the heat exchange medium introduced into the inlet passageway 154 of the guiding part 150 through the inlet pipe 131 moves to the supply passageway 152 through the opening and closing hole 156*a* opened by the bypass valve 164, and the heat exchange medium moving to the supply passageway 152 passes through the introduction hole 152*a* opened by the supply valve 162 and moves to the supply chamber 130*a* of the first tank 130.

The heat exchange medium moving to the supply chamber 130*a* is uniformly supplied to the tubes 101 of the left heat exchange part 100*a* and the tubes 101 of the right heat exchange part 100*b* through the supply holes 141 of the second tank 140.

The heat exchange medium supplied to the tubes 101 performs heat exchange with the outside air while flowing along the tubes 101 to heat the outside air, and then, moves to the lower tank 181.

The heat exchange medium moving to the lower tank 181 returns through the return pipe 190 and moves to the discharge passageway 153 of the guiding part 150, which is the discharge chamber 130*b* of the first tank 130. The heat exchange medium moving to the discharge passageway 153 of the guiding part 150 moves to the outlet passageway 155 through the opening and closing hole 158*a* opened by the discharge valve 165, and then, is discharged through the outlet pipe 132.

Next, when the supply valve 162 closes the introduction hole 152*a* (bypass mode), the bypass valve 164 maximally opens the opening and closing hole 157*a* of the partitioning wall 157 located between the inlet passageway 154 and the outlet passageway 155 and closes the opening and closing hole 156*a* of the partitioning wall 156 located between the inlet passageway 154 and the supply passageway 152. In this instance, the discharge valve 165 closes the opening and closing hole 158*a* of the partitioning wall 158 located between the discharge passageway 153 and the outlet passageway 155.

Therefore, the heat exchange medium introduced to the inlet passageway 154 of the guiding part 150 through the inlet pipe 131 is bypassed to the outlet passageway 155 through the opening and closing hole 157*a* opened by the bypass valve 164, and then, directly discharged through the outlet pipe 132.

Meanwhile, when the supply valve 162 partly opens the introduction hole 152*a*, the bypass valve 164 is located at a special position inside the inlet passageway 154 and partly opens not only the opening and closing hole 157*a* of the partitioning wall 157 located between the inlet passageway 154 and the outlet passageway 155 but also the opening and closing hole 156*a* of the partitioning wall 156 located between the inlet passageway 154 and the supply passageway 152. In this instance, the discharge valve 165 partly opens the opening and closing hole 158*a* of the partitioning wall 158 located between the discharge passageway 153 and the outlet passageway 155.

Therefore, some of the heat exchange medium introduced to the inlet passageway 154 of the guiding part 150 through the inlet pipe 131 is bypassed to the outlet passageway 155 through the opening and closing hole 157*a* located between the inlet passageway 154 and the outlet passageway 155 and directly discharged through the outlet pipe 132, and the remainder of the heat exchange medium moves to the supply passageway 152 through the opening and closing hole 156*a* located between the inlet passageway 154 and the supply passageway 152. The heat exchange medium moving to the supply passageway 152 moves to the supply chamber 130*a* of the first tank 130 after passing through the introduction hole 152*a* partly opened by the supply valve 162.

The heat exchange medium moving to the supply chamber 130*a* is uniformly supplied to the tubes 101 of the left heat exchange part 100*a* and the tubes 101 of the right heat exchange part 100*b* through the supply holes 141 of the second tank 140.

The heat exchange medium supplied to the tubes 101 performs heat exchange with the outside air during flowing along the tubes 101 to heat the outside air, and then, moves to the lower tank 181.

The heat exchange medium moving to the lower tank 181 returns through the return pipe 190 and moves to the discharge passageway 153 of the guiding part 150, which is the discharge chamber 130*b* of the first tank 130. The heat exchange medium moving to the discharge passageway 153 of the guiding part 150 moves to the outlet passageway 155 through the opening and closing hole 158*a* partly opened by the discharge valve 165, and in this instance, mixed with the heat exchange medium bypassed from the inlet passageway 154. After that, the mixed heat exchange medium is discharged through the outlet pipe 1332.

As described above, the present invention can differently control the volume of the heat exchange medium flowing to the tubes 101 of the left heat exchange part 100*a* and the right heat exchange part 100*b* by separately operating the heat exchange medium controlling means 160 respectively mounted on the guiding parts 150, thereby independently controlling temperature of the driver's seat and the passenger's seat.

So, the present invention can realize a more compact air-conditioning system since a temp door (not shown) which is mounted on the front of the heat exchanger to independently control the temperature of the driver's seat and the passenger's seat in an air-conditioning system for a vehicle, particularly, an independently controllable air-conditioning system, can be omitted.

As described above, the present invention can independently control the temperature of the driver's seat and the passenger's seat since the heat exchange medium controlling means respectively control the volume of the heat exchange medium flowing through the tubes of the left heat exchange part and the right heat exchange part, and reduce a manufacturing cost and realize a compact structure since the temp door for controlling temperature is omitted from the air-conditioning system for the vehicle.

In addition, the present invention can reduce an operating force and increase durability since the heat exchange medium controlling means are in a rotational structure.

Moreover, the present invention can minimize a temperature difference of the right and left sides thereof since a plurality of the supply holes are formed in the second tank in stages and the heat exchange medium introduced into the supply chamber is supplied to the tubes through the supply holes so that the heat exchange medium is not concentrated on one side but uniformly distributed to the tubes.

Furthermore, the present invention can independently control the temperature of the left heat exchange part and the right heat exchange part using the one inlet pipe and the one outlet pipe, and detachably mount the external pipes with the inlet pipe and the outlet pipe with ease since the inlet pipe and the outlet pipe are mounted in the same direction.

Additionally, the present invention can control temperature minutely since the heat exchange medium controlling means control the opened and closed amount of the introduction holes of the guide parts to minutely control the volume of the heat exchange medium supplied to the tubes.

While the present invention has been described with reference to the particular illustrative embodiment, it is not to be restricted by the embodiment but only by the appended claims. It is to be appreciated that those skilled in the art can change or modify the embodiment without departing from the scope and spirit of the present invention.

What is claimed is:

1. A heat exchanger comprising:

a plurality of tubes whose both ends are combined to an upper header and a lower header, the tubes being divided into a left heat exchange part and a right heat exchange part;

an upper tank having a first tank combined to the upper header and a second tank embedded in the first tank, the first tank having an inlet pipe and an outlet pipe, the second tank having a pair of guiding parts dividing the inner space of the first tank into a supply chamber fluidically communicated with the tubes and a discharge chamber fluidically communicated with a return pipe in relation with a partitioning wall to thereby supply heat exchange medium received through an inlet pipe to the tubes of the left heat exchange part and the right heat exchange part and discharge the heat exchange medium, which is returned through the return pipe mounted in parallel with the tubes after passing through the tubes, to an outlet pipe;

heat exchange medium controlling means rotatably mounted on the guiding parts so as to independently operated by an external driving force, and adapted to control the volume of the heat exchange medium supplied to the tubes of the left heat exchange part and the right heat exchange part through the supply chamber from the inlet pipe; and a lower tank combined to the lower header for returning the heat exchange medium discharged from the tubes of the left heat exchange part and the right heat exchange part to the return pipe;

wherein the guiding part includes: a supply passageway and a discharge passageway partitioned by a bulkhead formed therein, the supply passageway having an introduction hole formed on the bottom thereof and fluidically communicating with the supply chamber, the discharge passageway fluidically communicating with the return pipe; and an inlet passageway and an outlet passageway formed in a circumferential direction of one side of the supply passageway, the inlet passageway fluidically communicating with the inlet pipe, the outlet passageway fluidically communicating with the outlet pipe; and wherein the guiding parts are formed to be spaced apart from the upper part of the second tank to form the supply chambers between the upper part of the second tank and the guiding parts; and wherein the second tank has a plurality of supply holes to uniformly supply the heat exchange medium, which is introduced to the supply chambers, to each of the tubes arranged in the lower part of the second tank.

2. The heat exchanger according to claim 1, wherein the guiding parts are spaced apart from each other by a predetermined interval on the second tank and respectively have opened upper ends.

3. The heat exchanger according to claim 2, wherein a sealing member is sealable mounted between the opened upper ends of the guiding parts and the inner wall of the first tank, and includes inlet communicating holes for fluidically communicating the inlet pipe with the inlet passageways of the guiding part, and outlet communicating holes for fluidically communicating the outlet pipe with the outlet passageways of the guiding parts.

4. The heat exchanger according to claim 2, wherein a housing part in which the guiding parts are contained is protrudingly formed on the upper end of the first tank, the housing part fluidically communicating the inlet pipe and the outlet pipe formed on the upper portion thereof with the inlet passageways and the outlet passageways of the guide parts and rotatably supporting the heat exchange medium controlling means.

5. The heat exchanger according to claim 2, wherein a plurality of partitioning walls are formed among the supply passageway, the discharge passageway, the inlet passageway and the outlet passageway for partitioning the passageways from one another and respectively having opening and closing holes opened and closed by the heat exchange medium controlling means.

6. The heat exchanger according to claim 5, wherein the heat exchange medium controlling means includes:

a rotary shaft rotatably mounted inside the supply passageway of the guiding part;

a supply valve protrudingly mounted on the lower end portion of the rotary shaft in a radial direction;

a connection member formed on the rotary shaft or the supply valve in such a way as to be rotated when the rotary shaft is rotated, an end portion of the connection member extending to the discharge passageway passing through the inlet passageway and the outlet passageway; and a discharge valve combined to the end portion of the connection member for opening and closing the opening and closing hole of the partitioning wall formed between the discharge passageway and the outlet passageway.

7. The heat exchanger according to claim 6 wherein a bypass valve is combined to the connection member and arranged inside the inlet passageway to open and close the opening and closing holes formed on the partitioning walls formed on both sides of the inlet passageway, whereby the heat exchange medium introduced into the inlet passageway through the inlet pipe is supplied to the supply passageway or bypassed to the outlet passageway.

8. The heat exchanger according to claim 1, wherein the a cross section area of the introduction hole formed on the bottom of the supply passageway is varied in such a way that the heat exchange medium is introduced little by little during an early opening of the introduction hole but introduced maximally during the maximum opening of the introduction hole.

9. The heat exchanger according to claim 8, wherein the introduction hole is divided into several parts.

10. The heat exchanger according to claim 8, wherein the introduction hole has an expanded hole formed at the maximally opened position.

11. The heat exchanger according to claim 1, wherein the return pipe is mounted between the left heat exchange part and the right heat exchange part, and has a separation wall formed therein in such a way that the heat exchange medium discharged from the tubes of the left heat exchange part and the heat exchange medium discharged from the tubes of the right heat exchange part flow to the upper tank in a separated state.

12. The heat exchanger according to claim 11, wherein the return pipe is a collapsible tube having the separation wall formed at the center of the inside thereof.

13. The heat exchanger according to claim 1, wherein a plurality of the return pipes are mounted in parallel with the tubes according to a temperature distribution and a flow amount.

* * * * *